United States Patent [19]

Skinner

[11] Patent Number: 4,694,901

[45] Date of Patent: Sep. 22, 1987

[54] APPARATUS FOR REMOVAL OF WELLBORE PARTICLES

[75] Inventor: James L. Skinner, Plano, Tex.

[73] Assignee: Atlantic Richfield Company, Los Angeles, Calif.

[21] Appl. No.: 759,806

[22] Filed: Jul. 29, 1985

[51] Int. Cl.[4] ..... E21B 37/08

[52] U.S. Cl. ..... 166/77; 166/222; 166/312

[58] Field of Search ..... 166/278, 105, 51, 105.1, 166/56, 372, 157, 312, 311, 222

[56] References Cited

U.S. PATENT DOCUMENTS

| | | | |
|---|---|---|---|
| Re. 31,495 | 1/1984 | Zublin | 166/312 |
| 3,464,495 | 9/1969 | Childers et al. | 166/312 |
| 3,662,828 | 5/1972 | Hutchison | 166/312 |
| 4,028,009 | 6/1977 | Gudzenko et al. | 166/51 |
| 4,223,724 | 9/1980 | Levoni et al. | 166/372 |
| 4,441,557 | 4/1984 | Zublin | 166/312 |
| 4,442,899 | 4/1984 | Zublin | 166/312 |
| 4,518,041 | 5/1985 | Zublin | 166/312 |

*Primary Examiner*—Stephen J. Novosad
*Assistant Examiner*—Bruce M. Kisliuk
*Attorney, Agent, or Firm*—Roderick W. MacDonald; Michael E. Martin

[57] ABSTRACT

A method and apparatus for removing solid particles which have settled out in a region of a wellbore which employs at least one pair of conduit means, one of said conduit means having nozzle means thereon, said conduit means being disposed in the region of settled particle and passing fluid through one conduit means and the nozzle means into region of settled particles to mix with same and recovering the mixture of fluid and particles from said region by way of the other conduit means.

10 Claims, 9 Drawing Figures

APPARATUS FOR REMOVAL OF WELLBORE PARTICLES

BACKGROUND OF THE INVENTION

In a number of areas of the world there is a problem associated with the production of fluids such as crude oil from a subterranean geologic formation or reservoir which is referred to in the oil patch as "sand control". Sand control means preventing or otherwise alleviating the buildup of particles in the producing wellbore. This particle buildup is caused by settling of the particles out of the produced fluids (oil, water, etc.) when those fluids reach the wellbore itself. Although the term "sand control" is used, it should be understood that the problem particles involved are not limited to sand grains, but can include other solid particles, such as clay particles, that are entrained in the fluids produced from the formation through the wellbore wall into the wellbore itself. Sand control can be a substantial problem when the produced fluids flow from an unconsolidated formation or even from a consolidated, but uncemented, formation.

Solid particle buildup occurs in a wellbore or one or more regions thereof depending upon the completion configuration of the well, e.g., wells completed so as to produce from two or more formations. The problem particles settle out of the produced fluids when those fluids enter the wellbore because the velocity of the produced fluids is reduced in the wellbore as compared to the interstitial velocities of those fluids within the formation matrix itself. This is particularly true in areas near the wellbore wall itself.

A conventional technique used to control sand (solid particle) buildup in producing wellbores is to underream the wellbore, i.e., enlarge the diameter of the wellbore in the area in which the produced fluids enter the wellbore from the formation, insert a slotted liner in the underreamed portion of the wellbore, the slotted liner being sized so as to allow an annular region between the liner and the wellbore wall, and disposing a solid subdivided material such as gravel in the annulus between the liner and the wellbore wall. This way, as produced fluid passes through the gravel pack into the interior of the slotted liner for production to the earth's surface, the gravel pack serves as a filter medium to help remove some of the entrained particles from the produced fluid passing there-through.

Another sand control technique conventionally used is to case the wellbore with metal casing in the fluid producing zone, pertorating the casing, and then pumping a slurry containing gravel or the like into the formation around the perforated casing.

Sand buildup within the wellbore can occur even when a gravel pack or other filtering medium is employed in the wellbore since the gravel pack's efficiency is selective with regard to particle size. Often, even though larger particles are trapped by the gravel pack, substantial amounts of smaller particles pass through the pack and settle out in the interior of the wellbore itself thus creating a sand control problem in spite of the presence of a gravel pack.

BRIEF SUMMARY OF THE INVENTION

In accordance with this invention, a method and apparatus are employed which compensates for the imperfect filtering action of a gravel pack or any other passive filtering system employed downhole in a wellbore so that it is not necessary that the gravel pack or other filtering medium employed prevent all particles from entering the interior of the wellbore itself.

In accordance with this invention, there is provided a method and apparatus for removing solid particles which have settled out in at least one region of a wellbore by employing in such region at least one pair of conduit means, one of the conduit means having nozzle means thereon, and passing a fluid through the nozzle-bearing conduit means through the nozzle means and into the region of settled particles whereby the fluid mixes with the particles and the mixture of particles and fluid is then recovered by way of the other conduit means.

Accordingly, it is an object of this invention to provide a new and improved method and apparatus for sand control in a wellbore.

It is another object to provide a new and improved method and apparatus for augmenting the sand control realized with the use of gravel packs and similar passive filtering means employed in a wellbore.

It is another object to provide a new and improved method and apparatus for enhancing the productivity of a wellbore wherein at least part of the produced fluids from said wellbore contain entrained particles.

Other aspects, objects and advantages of this invention will be apparent to those skilled in the art from this disclosure and the appended claims.

DETAILED DESCRIPTION OF THE INVENTION

Figure 1:
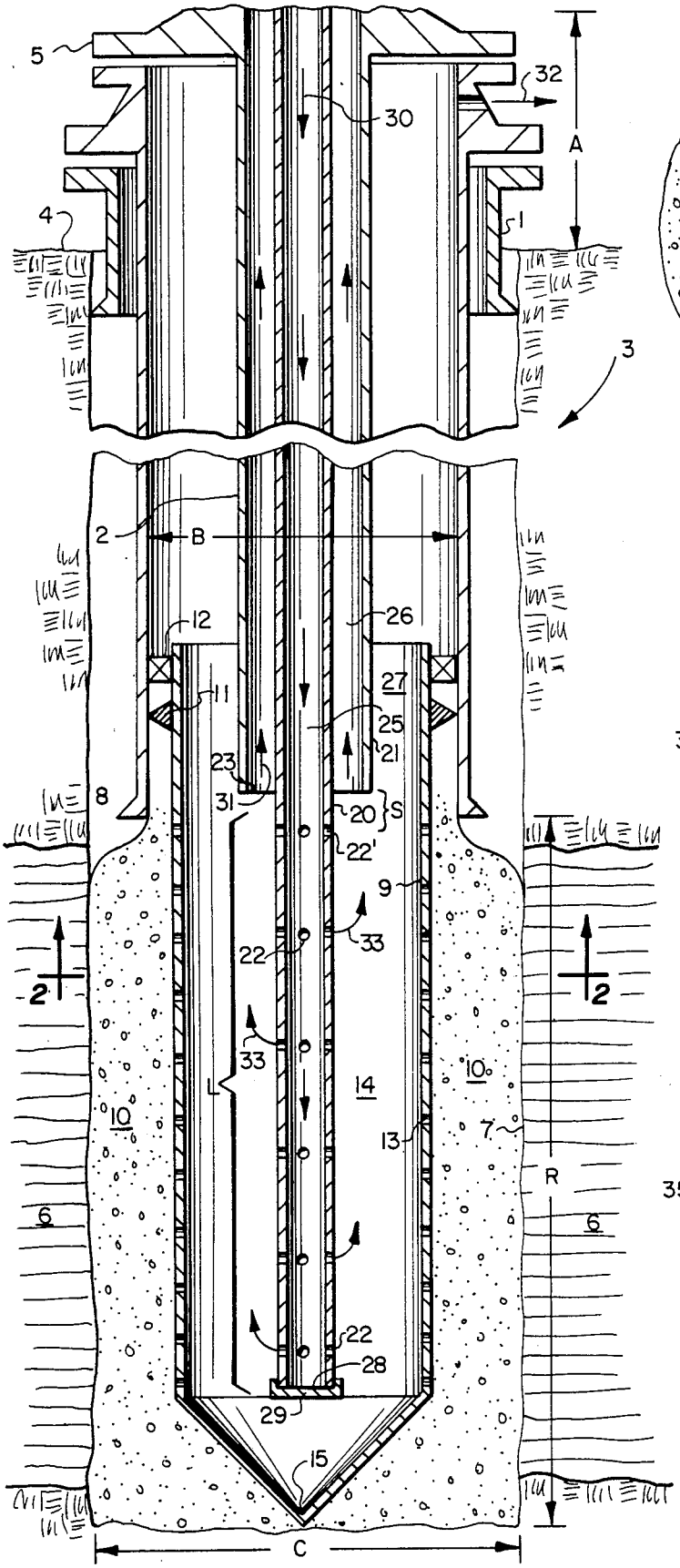
FIG. 1 shows a vertical cross section of a completed wellbore with gravel pack and employing one embodiment within this invention.

FIG. 1 shows a completed wellbore 3 without a wellhead for sake of simplicity. Area A shows the upper terminus of surface casing 1 and well casing 2 which extend to varying depths in wellbore 3 and which terminate above earth's surface 4. These various casing sections are connected to the bottom 5 of a wellhead (not shown). Casing 2 extends down to just above oil and/or gas, etc. producing formation or reservoir 6. Produced fluid such as oil, gas, water, and/or other fluids present inside formation 6 pass from formation 6 through wellbore wall 7 into the interior of wellbore 3. Below the lower terminus 8 of casing 2, wellbore 3 has been enlarged (underreamed) from diameter B to diameter C to make room for the insertion in region R of a conventional slotted liner 9 and gravel pack 10. Region R is a region of wellbore 3 where solid particles such as sand, clay, and the like which are entrained or otherwise produced with fluids passing from formation 6 through wellbore wall 7 into the interior of wellbore 3 will settle out.

Liner 9 is centrally spaced by way of spacer 11 in a conventional manner and is sealed in a fluid-tight manner by way of pack-off 12 so that fluid entering the wellbore must pass through gravel pack 10 and slots 13 in liner 9 to reach the inner chamber 14 of liner 9. From inner chamber 14, produced fluid from formation 6 flows or is otherwise pumped or forced to the earth's surface 4, as shown by arrow 32, through the interior of casing 2 or through production tubing (not shown) within casing 2 in any number of conventional ways well known in the art.

In many areas of the world, even with the best gravel pack 10 and slotted liner 9, some entrained particles will reach inner chamber 14, will therein settle out to bottom 15 of chamber 14, and will continue to collect and buildup within chamber 14 until they reach as high as pack-off 12 or even higher in wellbore 3 thereby substantially restricting the flow of fluids from formation 6 into inner chamber 14 and thence to the earth's surface for recovery.

In accordance with this invention, at least one pair of conduit means 20 and 21 are provided in region R. First conduit means 20 carries a plurality of nozzle means 22 spaced around the circumference thereof and along a portion of the longitudinal length L of first conduit means 20 within region R. Lower terminus 23 of second conduit means 21 extends downwardly into wellbore 3 towards or into region R until it approaches the point where nozzle means 22 first appear on first conduit means 20, i.e., nozzle means 22' in FIG. 1.

Second conduit means 21 is spaced from upper most nozzle means 22' so that second conduit means 21 does not overlap any of nozzle means 22' or 22 thereby leaving a finite space S between lower terminus 23 and uppermost nozzle means 22'. The length of space S is not critical to obtaining the benefits of this invention although it is preferred that terminus 23 be relatively close to first (uppermost) nozzle means 22'. Space S, depending upon the particular situation in the well can vary from 1 inch to 5 or more feet but is preferably in the range of from about 3 inches to 3 feet and still more preferably less than 1 foot. Length L of first conduit means 22 which is the length of that conduit means in zone R can vary considerably but preferably covers a substantial portion of the vertical length of inner chamber 14 and can even approach, although does not necessarily need to reach completely to, bottom 15 of inner chamber 14. Thus, first conduit means 20 can extend for essentially the full vertical length of inner chamber 14 but can also extend for less than half that length although at least half that length is presently preferred.

First and second conduit means 20 and 21 extend to or are otherwise in separate fluid communication with the earth's surface 4 so that fluid can be passed down the interior 25 of first conduit means 21 out through nozzle means 22 into inner chamber 14 as shown by arrow 33, and then pass from inner chamber 14 into the interior annulus 26 of second conduit 21 as shown by arrow 31 for return to and recovery at earth's surface 4. The relative cross sectional areas of conduit means 20 and 21 can vary considerably within this invention but are presently generally preferred to be chosen so that the horizontal cross-sectional area of the interior 25 of first conduit means 20 is approximately the same as the return cross-sectional area of second conduit means 21, i.e., the horizontal annular cross-sectional area 26. It should be understood though that the relative cross-sectional areas of fluid flow through conduits 20 and 21 need not be equal or even generally the same in order to obtain the benefits of this invention.

In the practice of this invention, annular zone 27 above terminus 23 may be closed off in a liquid-tight manner but this is not necessary in order to practice this invention, optimum results of this invention being achievable even when annular zone 27 is left open as shown in FIG. 1.

Lower terminus 28 of first conduit means 20 is sealed by way of cap means 29 so that fluid passing from the earth's surface down through interior 25 of first conduit means 20 as shown by arrow 30 is forced to exit from interior 25 through nozzle means 22 into inner chamber 14 for mixing with solid particles in that chamber. The mixture of fluid from the interior of first conduit means 20 and settled solid particles in inner chamber 14 then rises in that chamber until it enters second conduit means 21 as shown by arrow 31 for removal to and recovery at earth's surface 4.

Nozzle means 22 can simply be an aperture through the wall of first conduit means 20 as shown in FIG. 1 or can be specially designed mechanical devices (not shown) which are attached to apertures 22. Nozzle design can vary widely depending upon the type of flow pattern desired to be established for the fluid as it leaves interior 25 of first conduit means 20 and enters and passes through inner chamber 14 on its way toward inlet end 23 of second conduit means 21. One or more or all of nozzle means 22' and 22 can be angled at the same or varying angles and directions to establish any desired type of turbulent or laminar flow of fluid in chamber 14. For example, all or a substantial number of nozzle means 22' and 22 can be angled so that a vortex pattern of flow is established in inner chamber 14, such vortex resembling an inverted tornado with its widest area of flow near bottom 15 and narrowing down to its smallest area of flow at fluid entry point 23 second conduit means 21. Other types of flow patterns can be established by way of the placement and/or design of all or part of nozzle means 22' and 22 which will be obvious to those skilled in the art and which are within the scope of this invention so long as such placement and/or design effectively picks up or otherwise moves settled particles in inner chamber 14 and directs same to and through second conduit means 21.

The size of the opening or aperture through nozzle means 22' and 22 can vary widely depending on the particular characteristics of the well, the fluid employed, the particles present in inner chamber 14, and the like but will generally vary from about 1/16 inch to about ½ inch in diameter, preferably from about ⅛ to about 3/16 inch in diameter, when using a first conduit means 20 having an inside diameter of from about 1 to about 2 inches with a second conduit means 21 having an inside diameter of from about 2 inches to about 3 inches, it being obvious that inner conduit means 20 and outer conduit means 21 can not both be 2 inches in diameter. Nozzle means 22' and 22 can be emplaced in any desired configuration around and along length L of first conduit means 20 inside region R and are preferably spaced from one another by a distance of at least ½ inch laterally around the circumference and from about 3 inches to about 5 feet longitudinally along length L of first conduit means 20.

The first and second conduit means arrangement of this invention can be emplaced in the wellbore permanently in which case second conduit means 21 could be employed for additional uses such as an injector for a gas lift operation or an injector for weighted drilling mud to kill a kick or other pressure surge in the wellbore to prevent a blowout of the well. Other alternate applications for this apparatus in the operation and production of the well will be obvious to those skilled in the art.

Nozzle means 22 can be spread out over essentially the entire length L of first conduit means 20 or can be extended over only a portion of such length (such as the lower half of such length) or less including concentrating essentially all of the nozzle means at or near lower end 28 as will be described hereinafter in greater detail. For example, nozzle means 22 could extend over no more than the lowest ¼ of length L, i.e., the ¼ closest to lower end 28.

Figure 2:
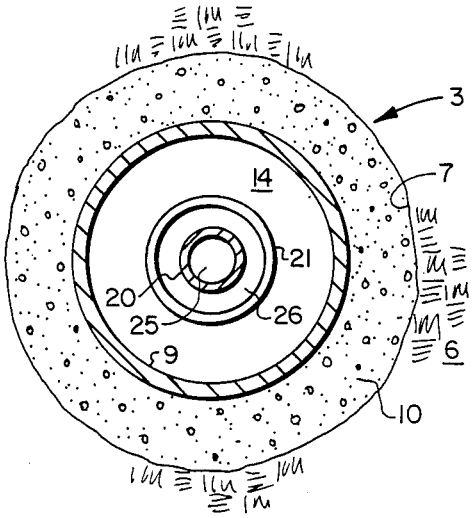
FIG. 2 shows a horizontal cross section of the apparatus of FIG. 1.

FIG. 2 shows a cross-sectional area of the apparatus of FIG. 1 showing the round or annular configuration for wellbore 7 and elements 9, 10, 14, 20, 21, 25, and 26.

Figure 3:
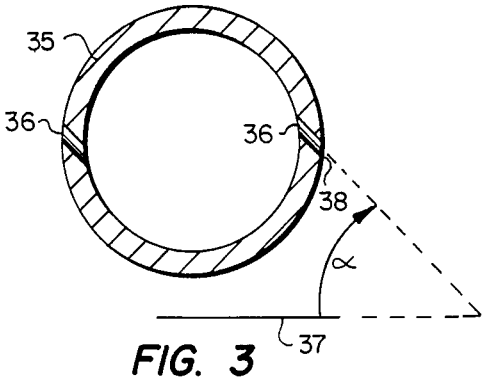
FIG. 3 shows a horizontal cross section of a nozzle-bearing conduit means within this invention.

FIG. 3 shows a transverse cross-sectional view of a first conduit means 35 similar to conduit means 20 of FIG. 1 wherein two nozzle means 36 are employed in first conduit means 35. In this particular embodiment, nozzle means 36 are angled with respect to the wall of conduit means 35 by an angle alpha which is defined as an angle with respect to a line 37 which is drawn perpendicularly to the wall of conduit means 35. Put another way, if line 37 was drawn perpendicular to the wall of conduit means 35 at the point where either nozzle means 36 exits to the exterior of conduit means 35 as shown for example, at point 38, alpha is the angle with respect to that line. Angle alpha can vary widely but is generally within the range of from about 20 to about 90 degrees.

Figure 4:
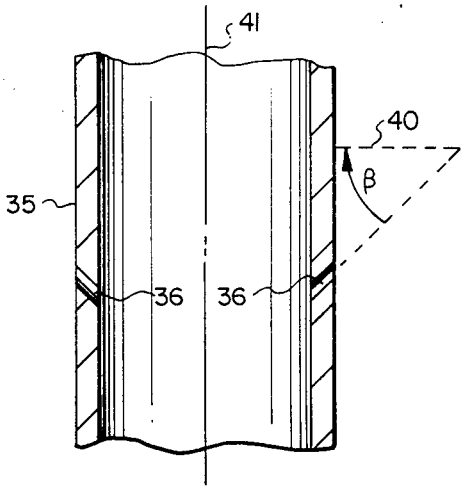
FIG. 4 shows a vertical cross section of a nozzle-bearing conduit means within this invention.

FIG. 4 shows that the nozzle means 36 can also be angled with respect to the transverse axis 40 of first conduit means 35. Thus, nozzle means 36 are shown in FIG. 4 to be disposed at an angle beta with respect to a transverse (horizontal) axis which is essentially perpendicular to the longitudinal (vertical) axis 41 of first conduit means 35. The angle beta can also vary widely but is generally within the range of from about 0 to about 80 degrees and can be angled downwardly as well as upwardly.

Further, it should be understood that the degree of angling, if any, for nozzles 36 in either the horizontal plane of FIG. 3 of the vertical plane of FIG. 4 need not all be the same for a given first conduit means but can be varied from nozzle to nozzle as desired to set up any desired flow pattern or turbulence pattern in inner chamber 14.

Figure 5:
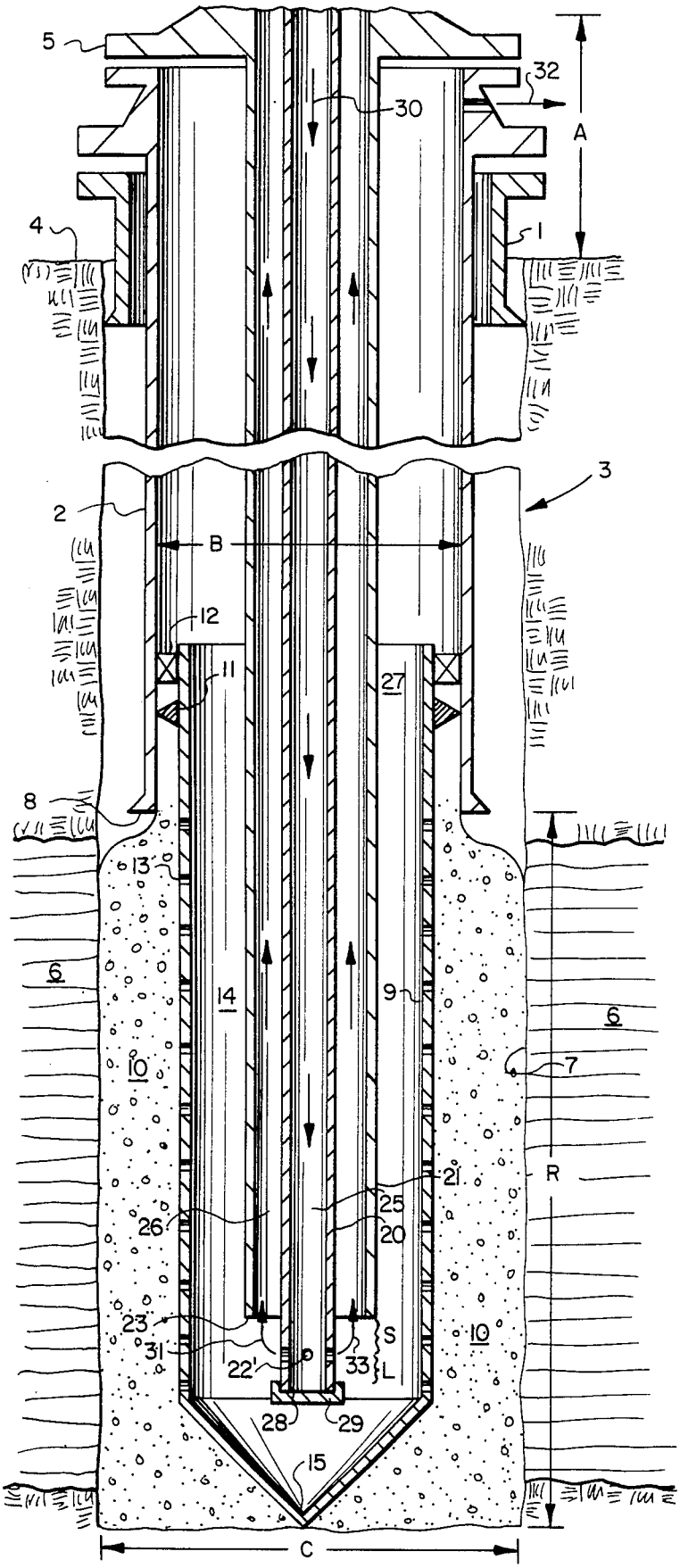
FIG. 5 shows a vertical cross section of a completed wellbore employing yet another embodiment within this invention.

FIG. 5 shows the apparatus of FIG. 1 modified in that uppermost nozzle means 22' on first conduit means 20 has been moved down into the lower quarter of first conduit means and, as shown in FIG. 5, has been moved essentially to the lower end 28 of first conduit means 20. Second conduit means 21 has also been extended for essentially the full length of inner chamber 14 so that its lower terminus 23 is still close to but just above nozzle means 22'. Thus, although dimension S can remain about the same in between FIGS. 1 and 5, if desired, dimension L is very considerably shorter in FIG. 5 since the uppermost nozzle means are located at the lower end of first conduit means 20. By using the configuration of FIG. 5, more complete removal of solid particles deposited in inner chamber 14 can be accomplished even if the initial operation of fluid flow through conduit means 20 and 21 occurs after the deposited particles have built up to a level above terminus 23 or even filled all or a substantial part of inner chamber 14. Accordingly, it can be seen that nozzle means 22' and 22 can be dispersed along the length L of first conduit means 20 for essentially the entire length of conduit means 20 in region R as shown in FIG. 1 or essentially only at the bottom of conduit means 20 in region R as shown in FIG. 5 or for any length intermediate the two extremes.

Figure 6:
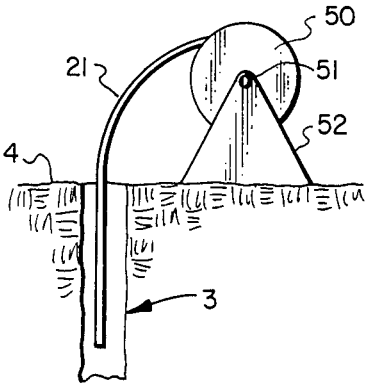
FIG. 6 shows a coiled tubing technique for practicing this invention.

FIG. 6 shows wellbore 3 with the apparatus of FIGS. 1 or 5 removed for sake of clarity. In the embodiment shown in FIG. 6, concentric conduit means 20 and 21 are employed in a form known as "coiled tubing" in which the conduit means are rolled up in a coil on spindle 50. Spindle 50 is rotatably carried at 51 by support base means 52 which rests on the surface of the earth 4. When conduit means 20 and 21 are rolled onto spindle 50, that spindle including supporting base 52 can be readily transported by vehicle or trailer from well to well for temporary workover purposes. Thus, when a well has sanded up to an extent that it adversely affects the productivity of the well and there is no means already in place in the wellbore to remove the sand that has settled out in the wellbore, spindle means 50 can be brought to the site of the sanded up wellbore by truck or other vehicular means for insertion of conduit means 20 and 21 into wellbore 3 off of spindle 50 to carry out the method of this invention. Thereafter, when the sand is removed from the interior of the wellbore and maximum productivity of the well reestablished, conduit means 20 and 21 can be removed from the wellbore, coiled onto spindle 50 and spindle 50 moved to another sanded up well for another workover. Obviously, support 52 can remain on the vehicle that conveys spindle 50 while carrying out the process of this invention, if desired, it not being necessary that spindle 50 and base 52 be removed from its conveying means each time a well is worked over.

The conduit means employed in the practice of this invention need not be used in the coiled tubing configuration shown in FIG. 6, but can also be used in a conventional manner, i.e., individual lengths of straight tubing about 30 feet long being joined at the earth's surface by conventional couplings and then fed down into wellbore 3 one length at a time.

Figure 7:
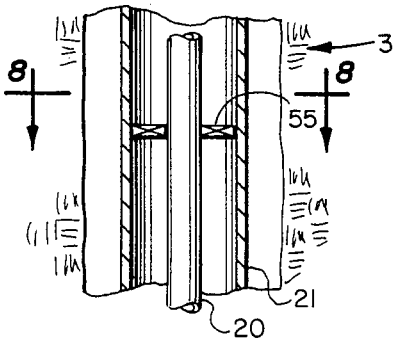
FIG. 7 shows a vertical cross section of one embodiment for the pair of conduit means of this invention.

FIG. 7 shows one embodiment of concentric tubing that can be employed for first and second conduit means in the practice of this invention including spacer means 55 to keep inner first conduit means 20 essentially centrally spaced in the interior of outer second conduit means 21.

Figure 8:
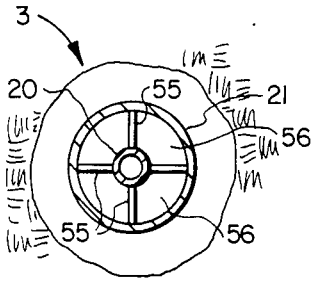
FIG. 8 shows a horizontal cross-sectional view of the embodiment of FIG. 7.

FIG. 8 is a cross-sectional view of the wellbore and apparatus of FIG. 7, and shows that spacer means 55 has apertures 56 therein to allow for fluid flow through conduit means 21.

One or more pairs of concentric first and second conduit means can be employed in a given wellbore. However, the one or more pairs of first and second conduit means used in this invention do not have to be concentric as shown in the earlier Figures. Rather, a pair of first and second conduit means can be disposed in a wellbore in side-by-side rather than concentric relationship.

Figure 9:
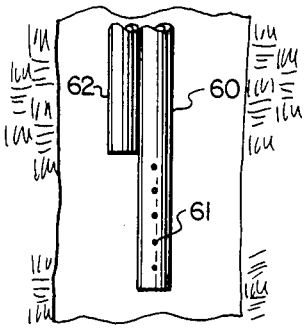
FIG. 9 shows another embodiment for the pair of conduit means of this invention.

FIG. 9 shows wellbore 3 to contain first conduit means 60 with nozzle means 61 dispersed over a lower portion thereof and second conduit means 62 extending along the side of, not concentric with, first conduit means 60. One or more pairs of side-by-side conduit means of FIG. 9 and, if desired, one or more pairs of concentric conduit means shown in FIG. 7 can be employed in the same wellbore if desired.

EXAMPLE

A 6-inch internal diameter steel pipe 40 feet long was packed with sand which passed a 20 mesh screen and was retained on a 40 mesh screen to simulate inner chamber 14 of the apparatus of FIG. 5. The sand was packed around two concentric pipes running down the center of the 6-inch pipe which concentric pipes represented first conduit means 20 and second conduit means 21 as shown in FIG. 5, conduit means 20 having a 1 inch internal diameter and conduit means 21 having a 2 inch internal diameter so that the radius of annulus 26 was about $1\frac{7}{8}$ inch. Four angled nozzles $\frac{1}{8}$ inch in diameter were drilled in first conduit means 20 near the bottom thereof as shown in FIG. 5. The nozzles were drilled at an angle alpha of approximately 45 degrees and an angle beta of 0 degrees.

Fresh water was injected through the interior of conduit means 20 through the entire 40 foot length of the 6 inch pipe and out the bottom of the 40 foot length of conduit means 20 through the $\frac{1}{8}$ inch-nozzle means 22' to establish a swirl or vortex composed of a mixture of water and sand in the bottom of the 6-inch pipe. Bottom terminum 23 for second conduit 21 was spaced a distance S of about 2 inches above nozzle means 22'. The resulting slurry of sand and water was forced upwardly into annulus 26.

It was noted during this operation that an efficient gravity feed was established as the sand slurry was removed by way of second conduit means 21 so that the sand in the 6-inch pipe above terminus 23 readily settled towards the bottom of that pipe to be picked up by the established vortex and carried into annulus 26 and from there up to the top of the 6-inch pipe.

When 25 gallons per minute of water was injected into interior 25 of conduit means 20 at the top of the 6-inch pipe, essentially all of the sand which filled the 6-inch pipe was removed by way of second conduit means 21 in less than 30 minutes thereby demonstrating the surprising efficiency for the method and apparatus of this invention.

Resonable variations and modifications are possible within the scope of this disclosure without departing from the spirit and scope of this invention.

I claim:

1. In wellbore apparatus wherein a deep wellbore passes through at least one hydrocarbon fluid producing subterranean formation and an apertured liner is carried in said wellbore adjacent said hydrocarbon fluid producing formation, said liner defining an enclosed inner chamber within said liner and an external zone which extends from the outer wall of said liner to the wall of said wellbore, the improvement comprising:

an elongated coilable tubing insertable into said wellbore, said coilable tubing being configured to include first conduit means having inner and outer walls and which is in communication with the surface of the earth and extends into said inner chamber, said first conduit means extending for a substantial portion of the length of said inner chamber, said first conduit means having a plurality of spaced apart nozzle means carried on a portion thereof extending over substantially the entire length of said first conduit means in said inner chamber and adapted to direct flow of fluid radially outwardly into said inner chamber, and said nozzle means being arranged such as to induce substantially vortex flow of fluid emitting from said nozzle means within said inner chamber, at least second conduit means having inner and outer walls and which is in fluid communication with the surface of the earth separately from said first conduit means, said second conduit means extending around said first conduit means and forming a generally annular zone between the inner wall of said second conduit means and the outer wall of said first conduit means to provide a path by which fluid and entrained solids are removed from said inner chamber by way of said second conduit means, said annular zone having a cross-sectional flow area approximately the same as the cross-sectional flow area of said first conduit means so as to maintain a flow velocity of said fluid which will substantially prevent settling out of said solid particles in said inner chamber or said annular zone, said second conduit means terminating near the top of said inner chamber close to but spaced from the point where said nozzle means first appear on said first conduit means so that said second conduit means does not overlap said nozzle means, said improvement providing for circulating fluid through the interior of said first conduit means and out through said nozzle means into said inner chamber to entrain solid particles in said circulated fluid, said fluid then being removed from said inner chamber by way of said second conduit means whereby said solid particles that pass from said external zone through said liner and collect in said inner chamber are swept out of said inner chamber by said circulated fluid as it passes from said nozzle means through said inner chamber into said second conduit means.

2. The apparatus of claim 1 wherein said external zone between said liner and wellbore wall is essentially filled with a pack of solid subdivided material to aid in filtering other solid particles out of fluids produced from said producing formation through said wellbore wall and into said external zone.

3. The apparatus of claim 1 wherein said first conduit means extends for essentially the full length of said inner chamber.

4. The apparatus of claim 1 wherein said nozzle means are spaced around the circumference and along the longitudinal axis of said first conduit means.

5. The apparatus of claim 1 wherein said second conduit means terminates less than 1 foot from the point where said nozzle means first appear.

6. The apparatus of claim 1 wherein said nozzle means are disposed at an angle alpha with respect to a line drawn perpendicularly to the wall of said first conduit means.

7. The apparatus of claim 6 wherein said angle alpha varies within the range of from about 20 to about 90 degrees.

8. The apparatus of claim 1 wherein said nozzle means are disposed at an angle beta with respect to a horizontal axis which is essentially perpendicular to the longitudinal axis of said first conduit means.

9. The apparatus of claim 8 wherein said angle beta varies within the range of from about 0 to about 80 degrees.

10. In wellbore apparatus wherein a deep wellbore passes through at least one hydrocarbon fluid producing subterranean formation and a liner is carried in said wellbore adjacent said hydrocarbon fluid producing formation, said liner defining an enclosed inner chamber within said liner, the improvement comprising:

an elongated tubing means insertable into said wellbore, said tubing means being configured to include first conduit means having inner and outer walls and which is in communication with the surface of the earth and extends into said inner chamber, said first conduit means extending for a substantial portion of the length of said inner chamber, said first conduit means having a plurality of spaced apart nozzle means carried on a portion thereof extending over substantially the entire length of said first conduit means in said inner chamber and adapted to direct flow of fluid radially outwardly into said inner chamber, and said nozzle means being arranged such as to induce substantially vortex flow of fluid emitting from said nozzle means within said inner chamber, at least second conduit means having inner and outer walls and which is in fluid communication with the surface of the earth separately from said first conduit means, said second conduit means defining a flow passage by which fluid and entrained solids are removed from said inner chamber by way of said second conduit means, said flow passage having a cross-sectional flow area approximately the same as the cross-sectional flow area of said first conduit means so as to maintain a flow velocity of said fluid which will substantially prevent settling out of said solid particles in said inner chamber or said second conduit means, said second conduit means terminating near the top of said inner chamber close to but spaced from the point where said nozzle means first appear on said first conduit means so that said second conduit means does not overlap said nozzle means, said improvement providing for circulating fluid through the interior of said first conduit means and out through said nozzle means into said inner chamber to entrain solid particles in said circulated fluid, said fluid then being removed from said inner chamber by way of said second conduit means whereby said solid particles that pass into said liner and collect in said inner chamber are swept out of said inner chamber by said circulated fluid as it passes from said nozzle means through said inner chamber into said second conduit means.

* * * * *